US008620195B2

(12) United States Patent
Maeshima

(10) Patent No.: US 8,620,195 B2
(45) Date of Patent: Dec. 31, 2013

(54) TONER SUPPLY APPARATUS, TONER STORAGE CONTAINER, AND IMAGE FORMING APPARATUS INCLUDING SAME

(75) Inventor: Masanobu Maeshima, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 128 days.

(21) Appl. No.: 13/308,154

(22) Filed: Nov. 30, 2011

(65) Prior Publication Data

US 2012/0134716 A1 May 31, 2012

(30) Foreign Application Priority Data

Nov. 30, 2010 (JP) ..... 2010-267691
May 25, 2011 (JP) ..... 2011-116523

(51) Int. Cl.
*G03G 15/08* (2006.01)

(52) U.S. Cl.
USPC ..... 399/258; 399/263

(58) Field of Classification Search
USPC ..... 399/258, 263
See application file for complete search history.

(56) References Cited

U.S. PATENT DOCUMENTS

| | | | | |
|---|---|---|---|---|
| 5,027,152 | A * | 6/1991 | Oda et al. | 399/111 |
| 5,202,728 | A * | 4/1993 | Maeshima et al. | 399/114 |
| 6,289,195 | B1 * | 9/2001 | Ichikawa et al. | 399/262 |
| 6,389,250 | B1 * | 5/2002 | Numagami et al. | 399/111 |
| 6,671,475 | B2 * | 12/2003 | Katada et al. | 399/111 |
| 6,920,298 | B2 * | 7/2005 | Yamada et al. | 399/106 |
| 6,980,754 | B2 * | 12/2005 | Isomura et al. | 399/106 |
| 7,106,995 | B2 * | 9/2006 | Nagai et al. | 399/258 |
| 7,263,317 | B2 * | 8/2007 | Kubota et al. | 399/258 |
| 7,386,251 | B2 * | 6/2008 | Yamada et al. | 399/106 |
| 2004/0136746 | A1 * | 7/2004 | Komatsu et al. | 399/104 |
| 2006/0034641 | A1 * | 2/2006 | Yamada et al. | 399/258 |
| 2006/0171744 | A1 * | 8/2006 | Ikeda et al. | 399/262 |
| 2006/0216061 | A1 * | 9/2006 | Yamaguchi | 399/111 |

(Continued)

FOREIGN PATENT DOCUMENTS

| | | |
|---|---|---|
| JP | 06-161317 | 6/1994 |
| JP | 06-186844 A | 7/1994 |

(Continued)

OTHER PUBLICATIONS

Notice of Reasons for Rejection issued to JP Application No. 2011-116523 mailed Jul. 9, 2013.

*Primary Examiner* — Walter L Lindsay, Jr.
*Assistant Examiner* — David Bolduc
(74) *Attorney, Agent, or Firm* — Knobbe Martens Olson & Bear LLP

(57) ABSTRACT

The toner supply apparatus according to the present disclosure includes a shaft connection mechanism in which a first and a second joint are engaged to thereby enable transmission of rotation of a first shaft of a development device and a second shaft of a toner storage container. The first joint has a first engagement member biased from a first main body towards a second joint, and a biasing member for biasing the first engagement member. The second joint has a second main body and an engaging recessed portion engaging with the accommodated first engagement member in a configuration that is substantially incapable of rotation. When the first rotation axis is not aligned with the second rotation axis and the first engagement member is accommodated in the engaging recessed portion, the first engagement member inclines relative to the first or second rotation axis and can engage with the engaging recessed portion.

9 Claims, 13 Drawing Sheets

(56) References Cited

U.S. PATENT DOCUMENTS

| | | | | |
|---|---|---|---|---|
| 2007/0065181 | A1* | 3/2007 | Ookushi et al. | 399/222 |
| 2007/0086810 | A1* | 4/2007 | Yamada et al. | 399/258 |
| 2007/0092304 | A1* | 4/2007 | Yamada et al. | 399/258 |
| 2007/0098454 | A1* | 5/2007 | Yamada et al. | 399/258 |
| 2008/0038023 | A1* | 2/2008 | Eto | 399/258 |
| 2008/0080892 | A1* | 4/2008 | Yamaguchi | 399/111 |
| 2008/0138114 | A1* | 6/2008 | Chadani et al. | 399/167 |
| 2008/0138115 | A1* | 6/2008 | Chadani et al. | 399/167 |
| 2008/0145091 | A1* | 6/2008 | Hwang | 399/88 |
| 2008/0170887 | A1* | 7/2008 | Nishimura et al. | 399/262 |
| 2008/0170888 | A1* | 7/2008 | Eto et al. | 399/263 |
| 2008/0170889 | A1* | 7/2008 | Eto et al. | 399/263 |
| 2008/0170890 | A1* | 7/2008 | Nishimura et al. | 399/263 |
| 2008/0175629 | A1* | 7/2008 | Eto et al. | 399/262 |
| 2008/0240796 | A1* | 10/2008 | Morioka et al. | 399/279 |
| 2009/0003872 | A1* | 1/2009 | Yamada et al. | 399/106 |
| 2009/0028608 | A1 | 1/2009 | Takashima | |
| 2009/0042656 | A1 | 2/2009 | Asayama et al. | |
| 2009/0052940 | A1* | 2/2009 | Mizuno et al. | 399/120 |
| 2009/0052949 | A1* | 2/2009 | Kojima | 399/258 |
| 2009/0297220 | A1* | 12/2009 | Tanda et al. | 399/119 |
| 2010/0158575 | A1* | 6/2010 | Maeshima et al. | 399/262 |
| 2010/0189483 | A1* | 7/2010 | Inoue | 399/358 |
| 2010/0278559 | A1 | 11/2010 | Komatsu et al. | |
| 2010/0303503 | A1* | 12/2010 | Woo | 399/167 |
| 2011/0038649 | A1* | 2/2011 | Miyabe et al. | 399/119 |
| 2011/0123231 | A1* | 5/2011 | Ozawa et al. | 399/258 |
| 2011/0182615 | A1* | 7/2011 | Morishita | 399/111 |
| 2011/0188895 | A1* | 8/2011 | Eto | 399/260 |

FOREIGN PATENT DOCUMENTS

| | | | |
|---|---|---|---|
| JP | 08-146825 | | 6/1996 |
| JP | 2001-235933 | A | 8/2001 |
| JP | 2002-003115 | A | 1/2002 |
| JP | 2008-268927 | A | 11/2008 |
| JP | 2009-025751 | A | 2/2009 |
| JP | 2009-134234 | A | 6/2009 |
| JP | 2010-262056 | A | 11/2010 |

* cited by examiner

TONER SUPPLY APPARATUS, TONER STORAGE CONTAINER, AND IMAGE FORMING APPARATUS INCLUDING SAME

This application is based on and claims the benefit of priority from Japanese Patent Application Nos. 2010-267691 and 2011-116523, respectively filed on 30 Nov. 2010 and 25 May 2011, the contents of which are incorporated herein by reference.

BACKGROUND OF THE DISCLOSURE

1. Field of the Invention

The present disclosure relates to a toner supply apparatus and a toner storage container that form a part of an image forming apparatus such as a copying machine or the like, and to an image forming apparatus including the same.

2. Related Art

An image forming apparatus such as an electrophotographic copying apparatus includes a photosensitive drum, a development device, and a toner storage container. The photosensitive drum forms an electrostatic image on its peripheral face (surface) in accordance with an image input from an external device such as a PC (personal computer) or the like or an image of a document that is read using an image reading unit. The development device includes a development roller that attaches toner to the electrostatic image formed on the surface of the photosensitive drum and a first shaft rotation mechanism for rotating the development roller. The toner storage container includes a toner storage unit for storing toner, and a second shaft rotating mechanism for supplying toner stored in the toner storage container to the development device. When the first shaft rotation mechanism and the second shaft rotation mechanism are connected, rotation produced by the first shaft rotation mechanism is transmitted to the second shaft rotation mechanism. For example, a conventional technique includes a technique in which a fixing apparatus of a copying machine includes a universal joint provided between the two shaft rotation mechanisms, and the two shaft rotation mechanisms are connected by the universal joint.

However, for example, the photosensitive drum is fixed and positionally determined by mounting on the housing of the image forming apparatus. Suitable performance of the development operation by the development device (fixing toner onto the electrostatic image on the surface of the photosensitive drum) requires suitable determination of the positional relationship of the photosensitive drum and the development device (in particular, the interval between the surface of the development roller and the surface of the photosensitive drum). As a result, the development device is installed with reference to the position of the photosensitive drum. On the other hand, the toner storage container is fixed and positionally determined by mounting on the housing (the rail or the like) of the image forming apparatus in a similar manner to the photosensitive drum.

As a result, a deviation tends to be produced in the positional relationship of the developing device and the toner storage container. When a deviation is produced in the positional relationship of the developing device and the toner storage container, suitable connection between the first shaft rotation mechanism of the development device and the second shaft rotation mechanism of the toner storage container is not realized, and as a result, an impediment is caused in the transmission of the rotation produced by the first shaft rotation mechanism to the second shaft rotation mechanism.

SUMMARY OF THE DISCLOSURE

The present disclosure relates to a toner supply apparatus including a development device having a first shaft that rotates about a first rotation axis; a toner storage container for supplying toner to the development device and having a second shaft that rotates about a second rotation axis extending along the first rotation axis; and a shaft connection mechanism having a first joint and a second joint, and the first joint and the second joint engaging to enable connection of the first shaft and the second shaft in a direction along the first rotation axis and the second rotation axis, and enabling transmission of rotation between the first shaft and the second shaft; wherein the first joint having a first main body being substantially incapable of rotation with respect to either one of the first shaft or the second shaft, a first engagement member biased from the first main body towards the second joint, and a biasing member for biasing the first engagement member; the second joint having a second main body being substantially incapable of rotation with respect to the other of the first shaft or the second shaft, and an engaging recessed portion being provided on the second main body, opening towards the first joint, enabling accommodation of the first engagement member of the first joint and engaging with the accommodated first engagement member in a configuration that is substantially incapable of rotation; and when the first engagement member is accommodated in the engaging recessed portion and the first rotation axis is not aligned with the second rotation axis, the first engagement member inclines relative to the first rotation axis or the second rotation axis and can engage with the engaging recessed portion in that configuration.

Furthermore, the present disclosure relates to a toner storage container for supplying toner to a development device that has a first shaft that rotates about a first rotation axis, the toner storage container including a second shaft that rotates about a second rotation axis extending along the first rotation axis; and one of a first joint or a second joint of a shaft connection mechanism including a first joint and a second joint, the first joint and the second joint engaging to enable connection of the first shaft and the second shaft in a direction along the first rotation axis and the second rotation axis, and enabling transmission of rotation between the first shaft and the second shaft; wherein the first joint having a first main body being substantially incapable of rotation with respect to either one of the first shaft or the second shaft, a first engagement member biased from the first main body towards the second joint, and a biasing member for biasing the first engagement member; the second joint having a second main body being substantially incapable of rotation with respect to the other of the first shaft or the second shaft; and an engaging recessed portion being provided on the second main body, opening towards the first joint, enabling accommodation of the first engagement member of the first joint and engaging with the accommodated first engagement member in a configuration that is substantially incapable of rotation; and when the first engagement member is accommodated in the engaging recessed portion and the first rotation axis is not aligned with the second rotation axis, the first engagement member inclines relative to the first rotation axis or the second rotation axis and can engage with the engaging recessed portion in that configuration.

DETAILED DESCRIPTION OF THE DISCLOSURE

Figure 1:
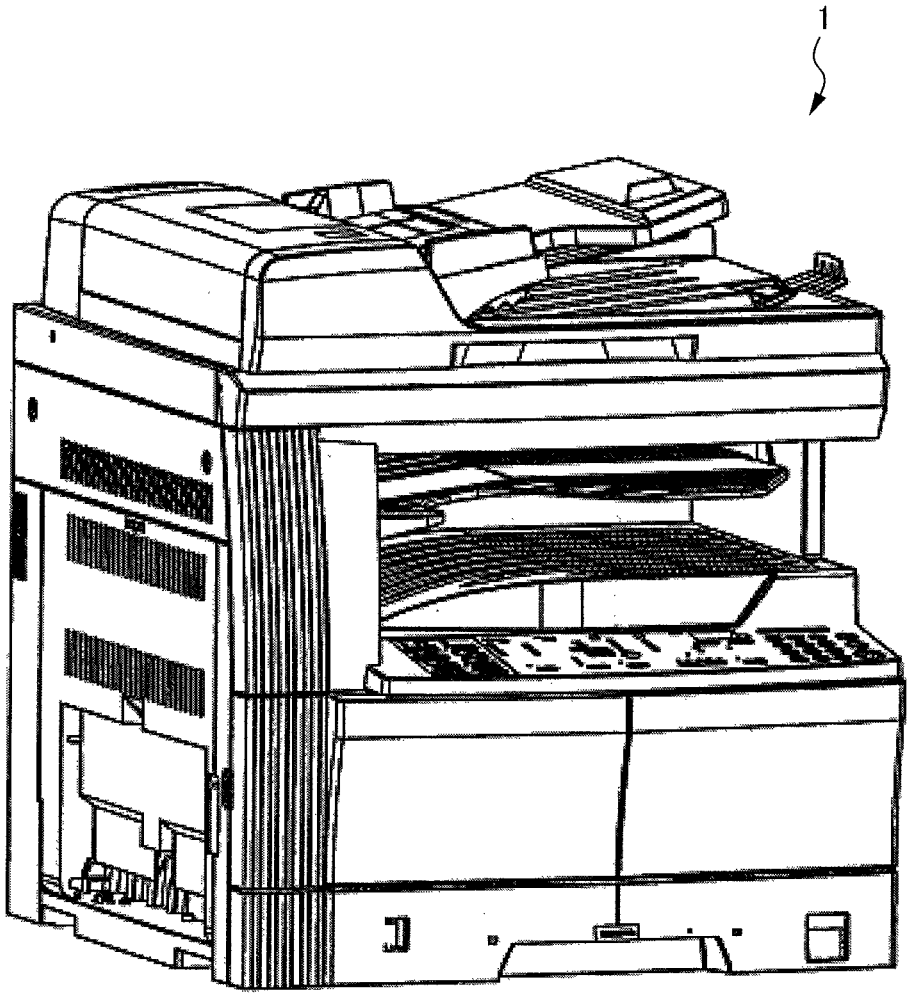
FIG. 1 is a perspective view of a copying machine 1 provided with a toner supply apparatus according to the present embodiment.
Figure 2:
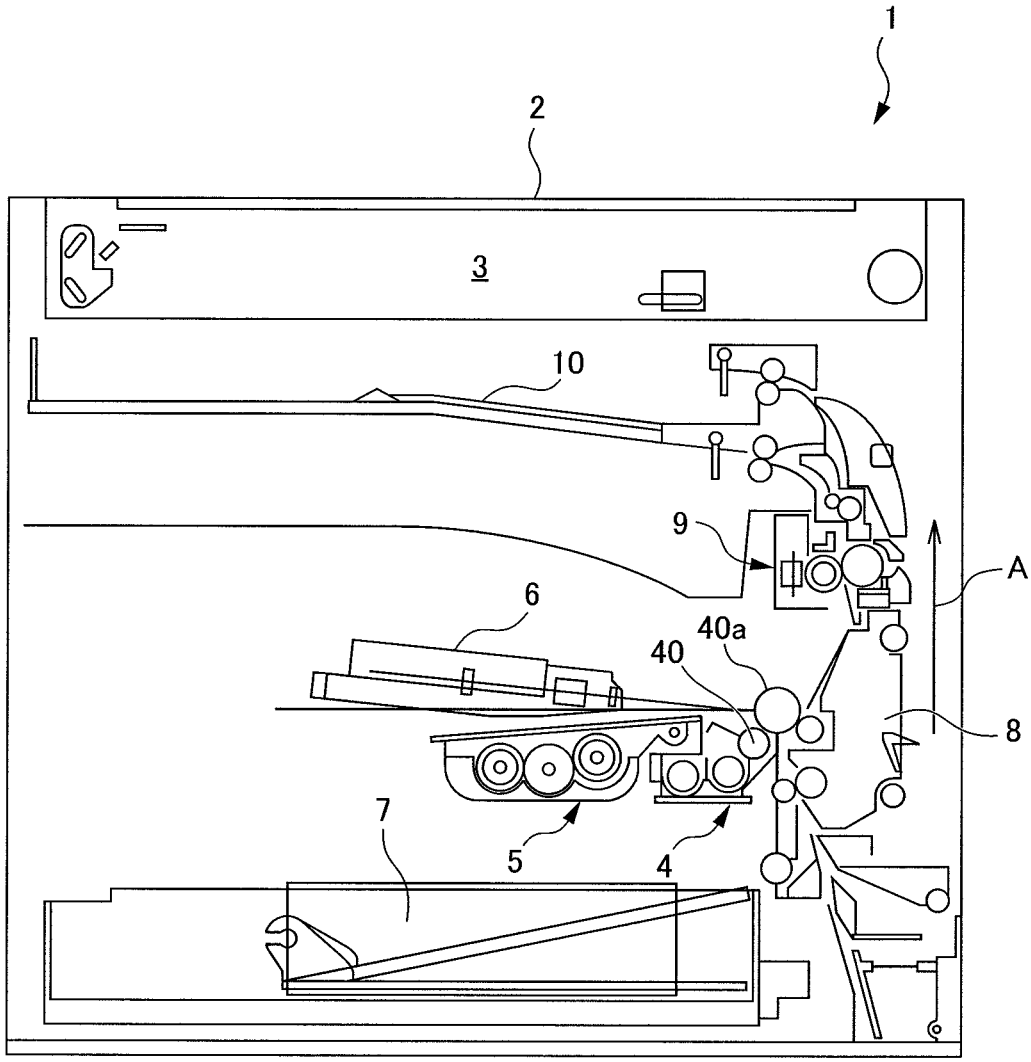
FIG. 2 illustrates a general configuration of the copying mechanism 1 illustrated in FIG. 1.

Firstly, the overall configuration of a copying machine will be described as an example of an image forming apparatus including the toner supply apparatus 30 and the toner storage container 5 according to an embodiment of the present disclosure. FIG. 1 is a perspective view of a copying machine 1 provided with a toner supply apparatus according to the present embodiment. FIG. 2 illustrates a general configuration of the copying mechanism 1 illustrated in FIG. 1.

As illustrated in FIG. 1 and FIG. 2, the copying machine 1 includes a document positioning glass plate 2, an image reading unit 3, a photosensitive drum 40*a* acting as an image carrier, the toner storage container 5, an exposure device 6, a sheet cassette 7, a conveying apparatus 8, a fixing unit 9, and a discharge tray 10.

The image reading unit 3 reads the image of a document placed on the document positioning glass plate 2 as image data. An electrostatic image is formed on the surface of the photosensitive drum 40*a*. The exposure device 6 irradiates laser light on the electrostatic image formed on the surface of the photosensitive drum 40*a* to thereby form an electrostatic image based on the image data of the document on the surface of the photosensitive drum 40*a*.

The development device 4 has a development roller 40 for attaching toner to the surface (peripheral surface). The development device 4 transfers the toner attached to the development roller 40 onto the electrostatic image formed on the photosensitive drum 40*a* of the document image to thereby form a toner image on the photosensitive drum 40*a*. The toner storage container 5 includes a toner storage unit 56 (refer to FIG. 5) for storing toner, and executes supply as suitable in a required amount of toner stored in the toner storage container 56 to the development device 4. The photosensitive drum 40*a* transfers a toner image onto copying paper (not shown) that acts as a sheet and is conveyed by the conveying apparatus 8 from the paper cassette 7 in the direction A of the arrow (refer to FIG. 2). The fixing unit 9 heats the copying paper including the transferred toner image and fixes the toner image to the copying paper. Thereafter the copying paper is discharged into the discharge tray 10.

Figure 3:
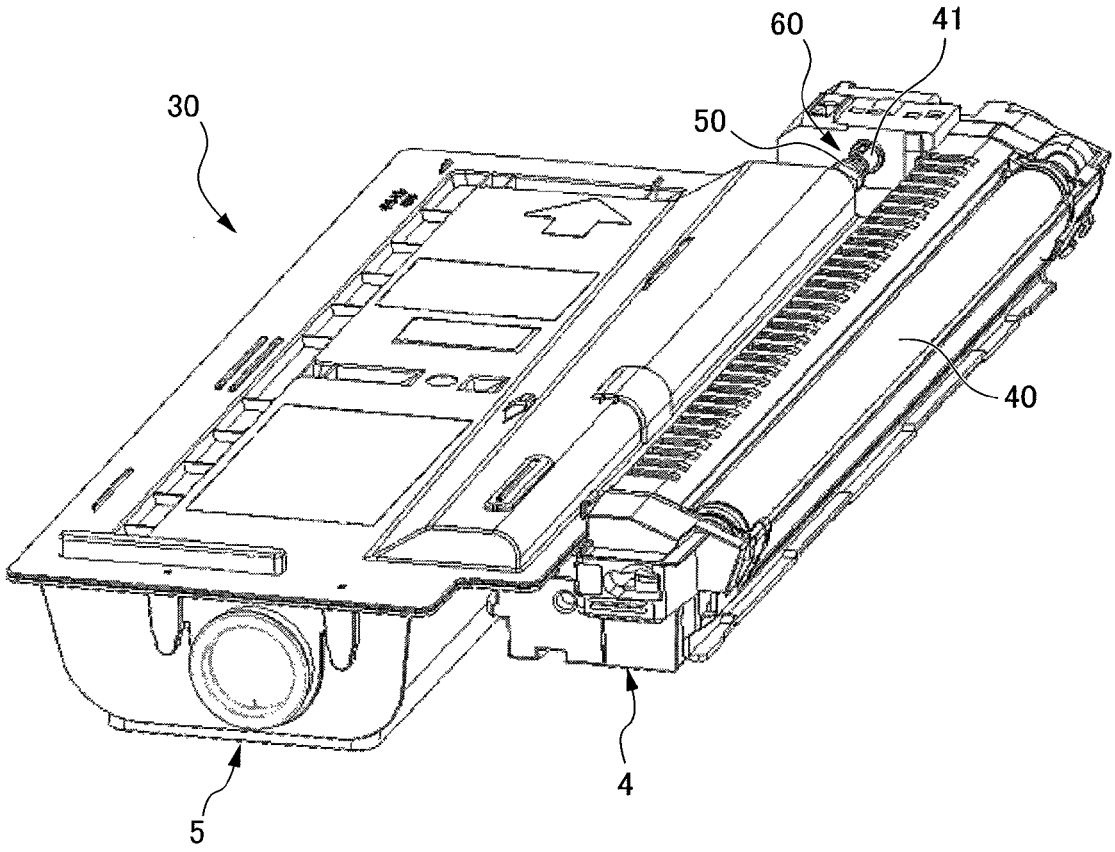
FIG. 3 is a perspective view illustrating the connected configuration of a development device 4 and a toner storage container 5 that configure a toner supply apparatus 30 according to the present embodiment.
Figure 4:
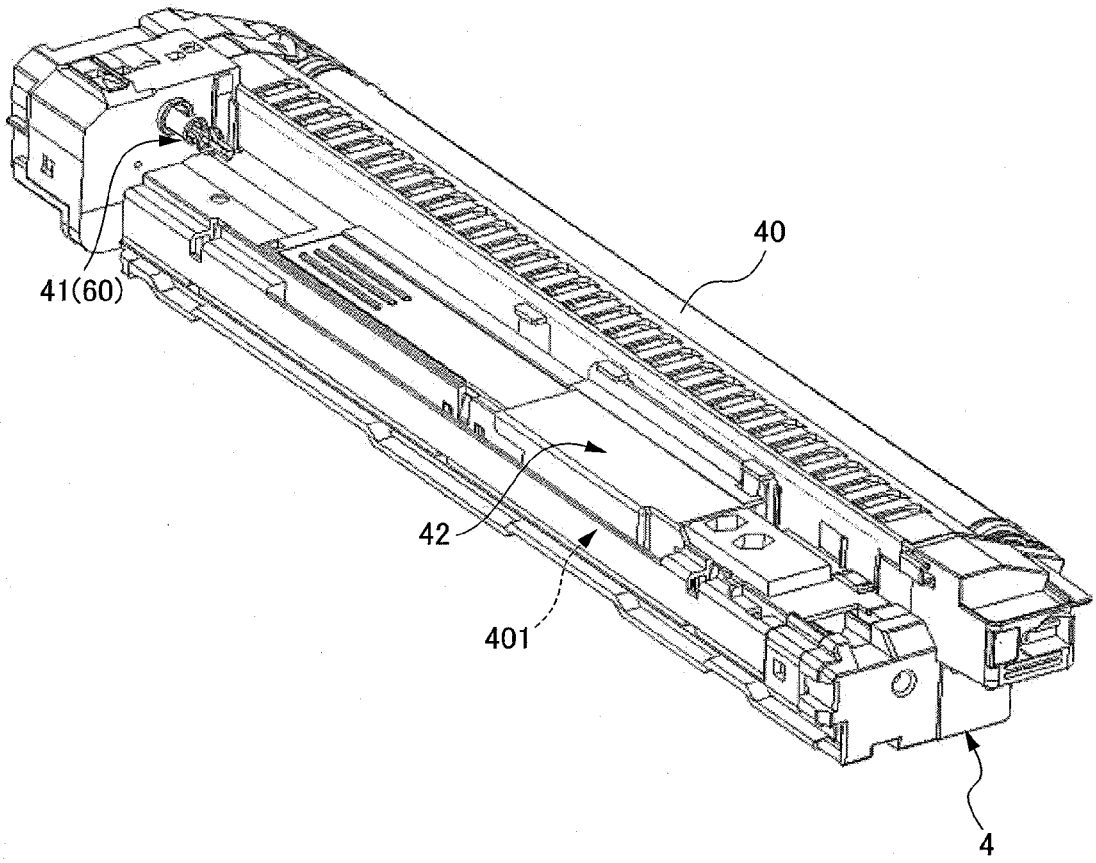
FIG. 4 is a perspective view illustrating the development device 4.
Figure 5:
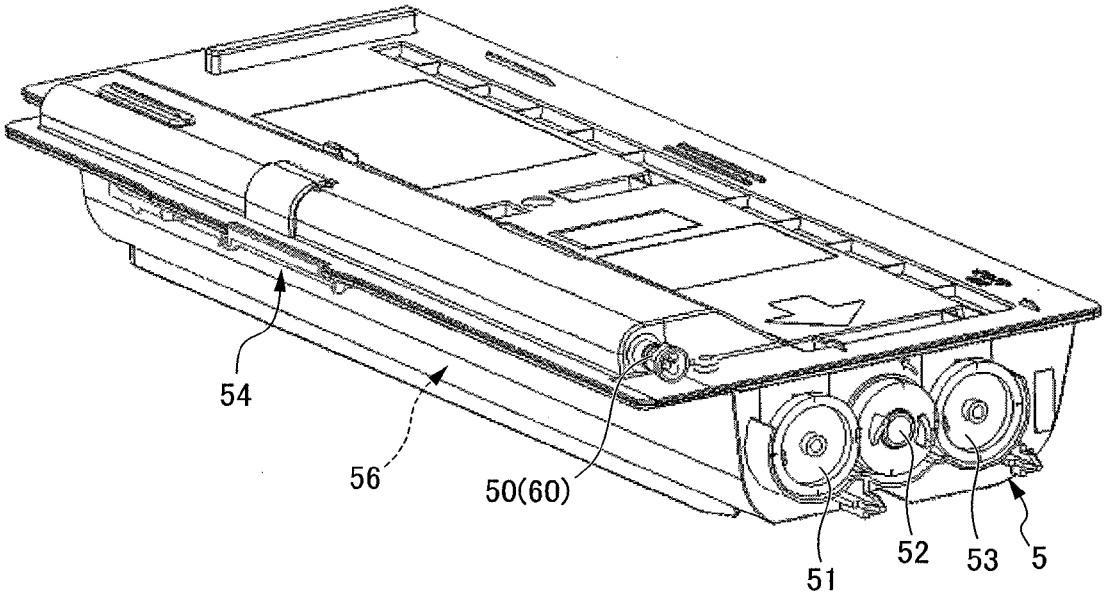
FIG. 5 is a perspective view illustrating the toner storage container 5.
Figure 6:
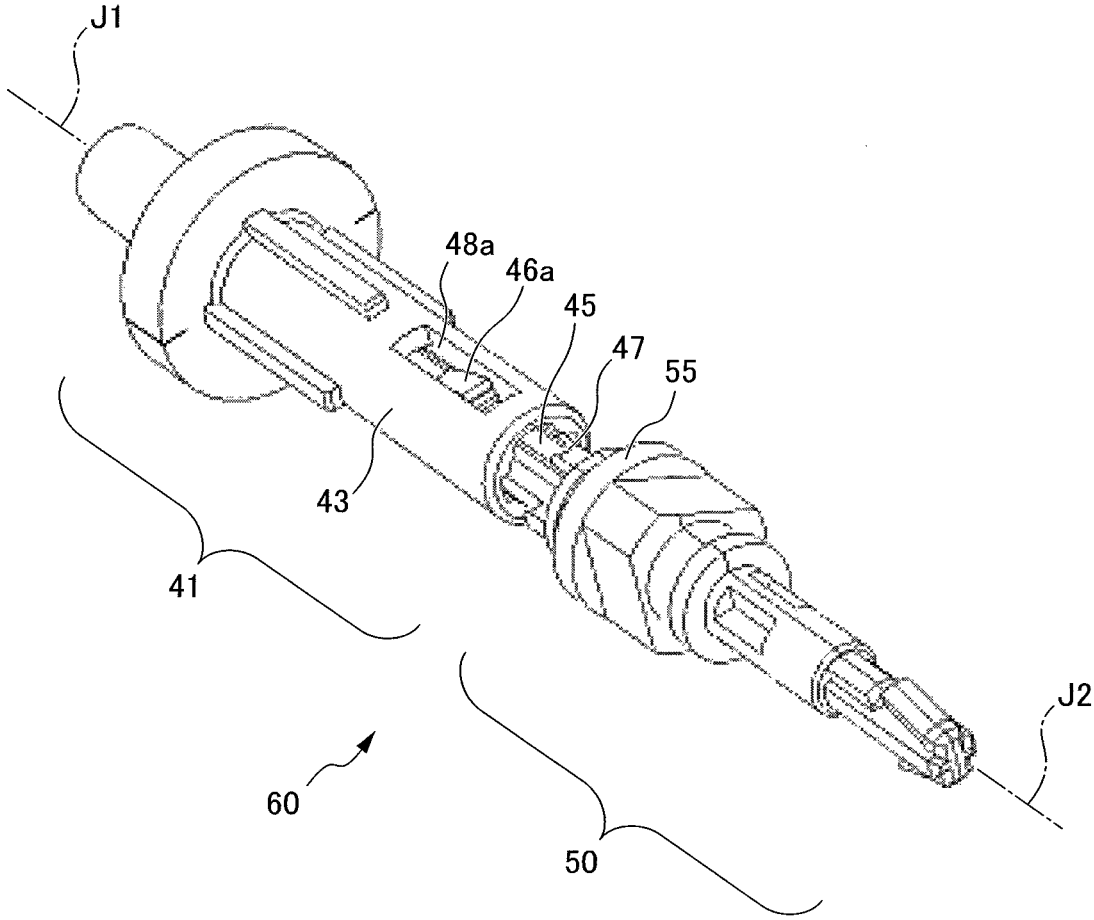
FIG. 6 is a perspective view illustrating the connected configuration of a first joint 41 and a second joint 50 that configure a shaft connection mechanism 60 in the toner supply apparatus.
Figure 7:
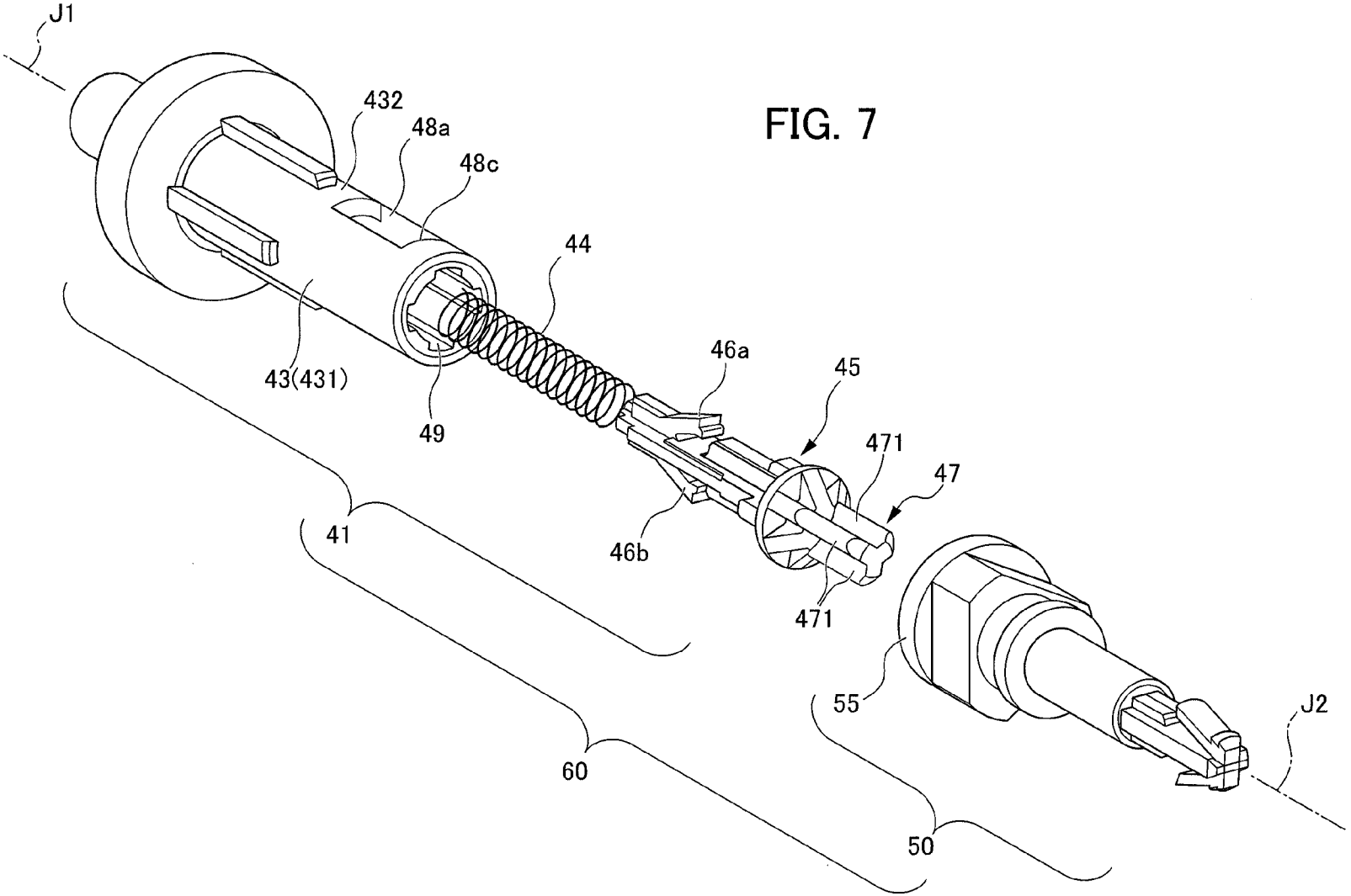
FIG. 7 is an exploded perspective view of the shaft connection mechanism 60.

Next, detailed description of the toner supply apparatus 30 and the toner storage container 5 according to an embodiment of the present disclosure will be given. The toner storage container 5 forms a part of the toner supply apparatus 30, and therefore the description will focus on the toner supply apparatus 30 according to the present embodiment. FIG. 3 is a perspective view illustrating the connected configuration of a development device 4 and a toner storage container 5 that configure a toner supply apparatus 30 according to the present embodiment. FIG. 4 is a perspective view illustrating the development device 4. FIG. 5 is a perspective view illustrating the toner storage container 5. FIG. 6 is a perspective view illustrating the connected configuration of a first joint 41 and a second joint 50 that configure a shaft connection mechanism 60 in the toner supply apparatus. FIG. 7 is an exploded perspective view of the shaft connection mechanism 60.

As illustrated in FIG. 3 to FIG. 5, the toner supply apparatus 30 according to the present embodiment is mainly configured by the development device 4, the toner storage container 5, and the shaft connection mechanism 60.

As illustrated in FIG. 3 to FIG. 7, the development device 4 includes a toner storage chamber 401 for storing toner, a development roller 40 having toner attached to a surface thereof, and a first shaft rotation mechanism (not shown) for conveying a required amount of toner from the toner storage chamber 401 to the proximity of the development roller 40. The first shaft rotation mechanism includes a first shaft (not shown) for rotating about the first rotation axis J1 (refer to FIG. 6) and rotating the development roller 40 and a first joint 41 connected to the first shaft.

The first shaft is a shaft that rotates in operable connection with a gear set (not shown) on a rotation shaft (not shown) of the development roller 40 in the development device 4. The development device 4 rotates the development roller 40 via the first shaft to thereby attach electrostatically-changed toner to the surface of the development roller 40. The development device 4 includes a first shutter 42 that opens when connected with the toner storage container 5.

As illustrated in FIG. 3 to FIG. 7, the toner storage container 5 includes a toner storage unit 56, a second shaft rotation mechanism 51, 52, 53, a second joint 50, and a second shutter 54. The toner storage unit 56 stores toner. The second shaft rotation mechanism 51, 52, 53 conveys toner to supply a required amount of toner stored in the toner storage unit 56 to the toner storage chamber 401 of the development device 4. The second shutter 54 opens when connected with the toner storage container 5 and the development device 4.

The toner storage container 5 includes a second shaft (not shown) that rotates about the second rotation axis J2 (refer to FIG. 6). The second rotation axis J2 extends in a direction along the first rotation axis J1 of the first shaft. The second shaft is a rotation shaft for a carrying screw (not shown). The carrying screw conveys toner from the toner storage container 5 to the toner storage chamber 401 of the development device 4 when the toner device 4 is connected to the toner storage container 5. The carrying screw is provided above the second shutter 54.

As illustrated in FIG. 3 to FIG. 7, the shaft connection mechanism 60 is mainly configured from the first joint 41 and the second joint 50. The shaft connection mechanism 60 connects the first joint 41 and the second joint 50 by engagement with the first joint 41 and the second joint 50. The shaft connection mechanism 60 connects the first shaft of the development device 4 and the second shaft of the toner storage container 5 in a direction along the first rotation axis J1 and the second rotation axis J2. The shaft connection mechanism 60 enables transmission of rotation between the first shaft and the second shaft in a configuration in which the first joint 41 is connected with the second joint 50.

Figure 8:
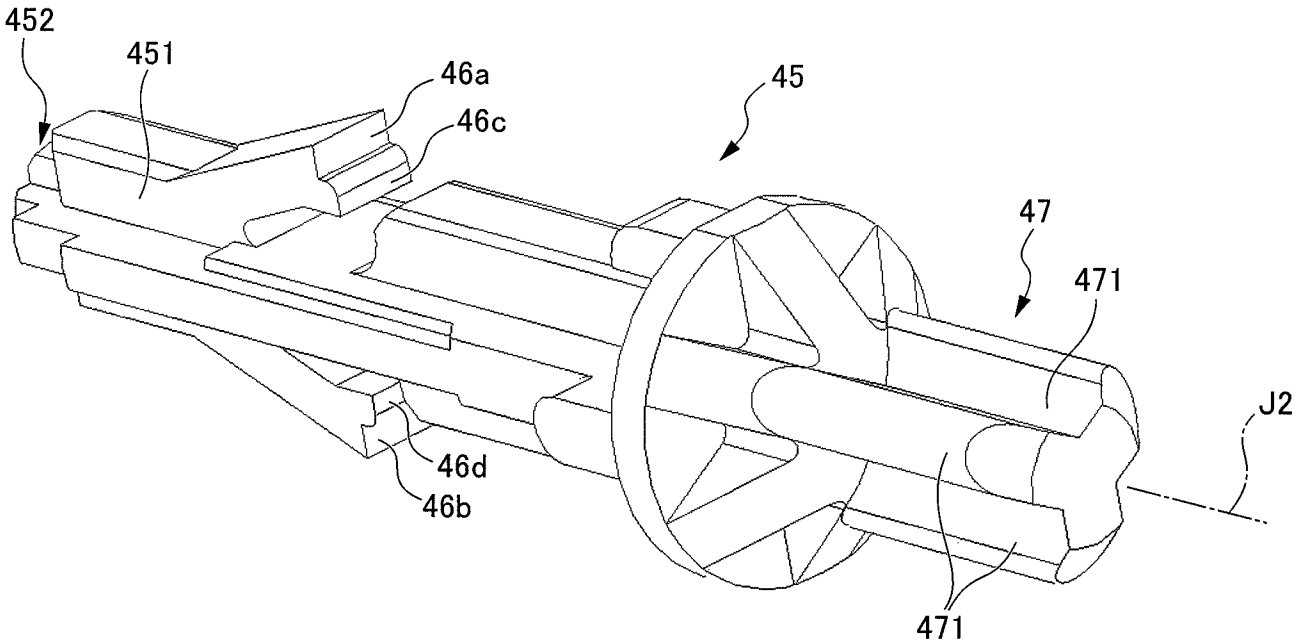
FIG. 8 is a perspective view illustrating a first engagement member 45 of a first joint 41.
Figure 9A:
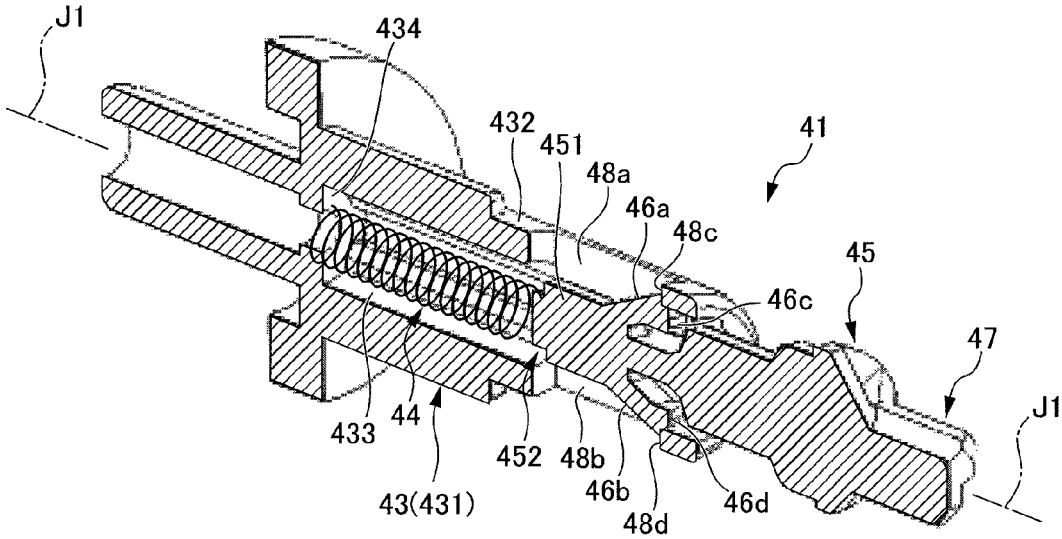
FIG. 9A is a sectional view illustrating a section of the first joint 41 on a sectional surface including a first rotation axis J1.
Figure 9B:
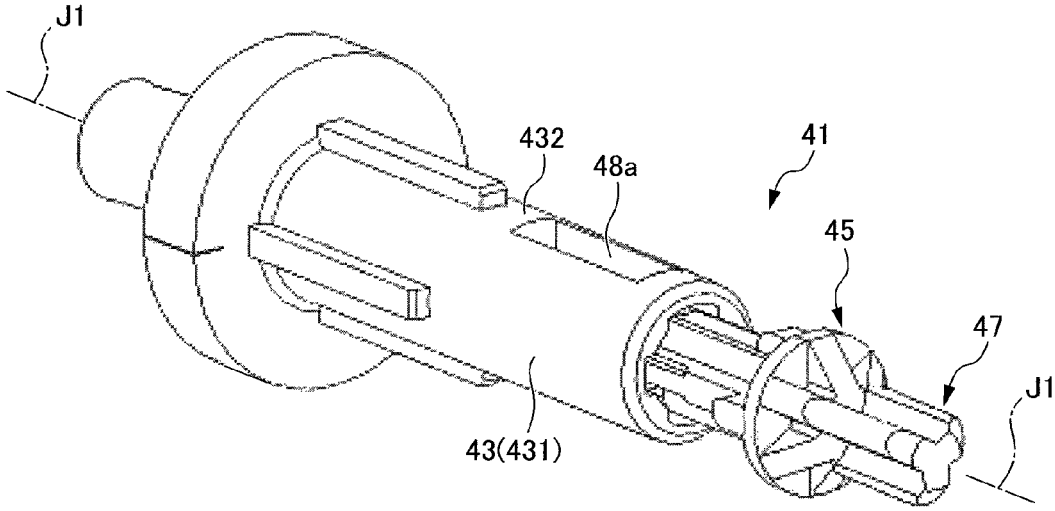
FIG. 9B is a perspective view illustrating the first joint 41.
Figure 10A:
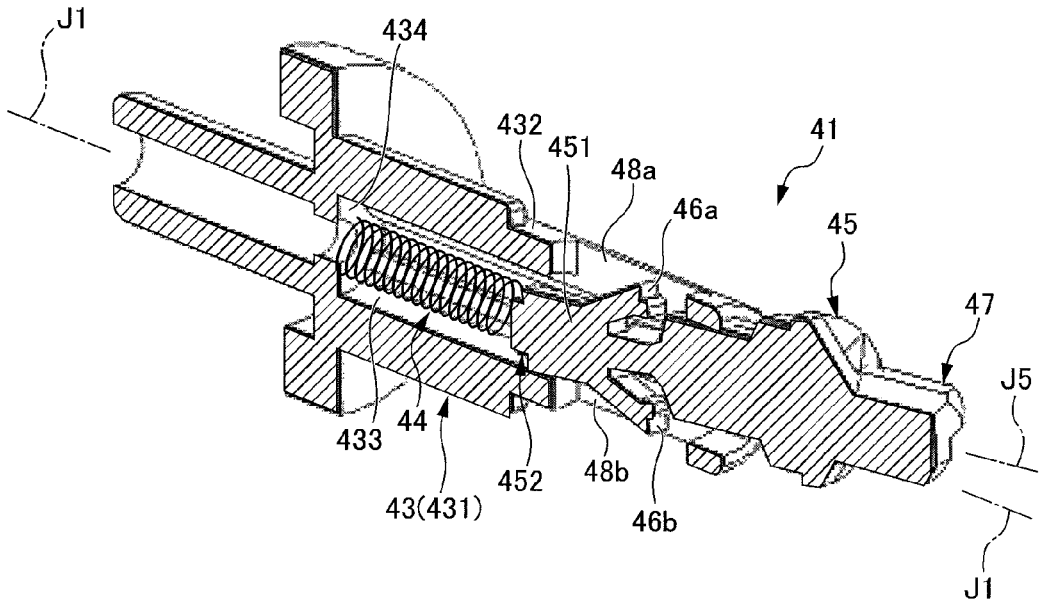
FIG. 10A is a sectional view illustrating a section of the first joint 41 on a sectional surface including the first rotation axis J1 when the first engagement member 45 is in an inclined configuration with respect to the first rotation axis J1.
Figure 10B:
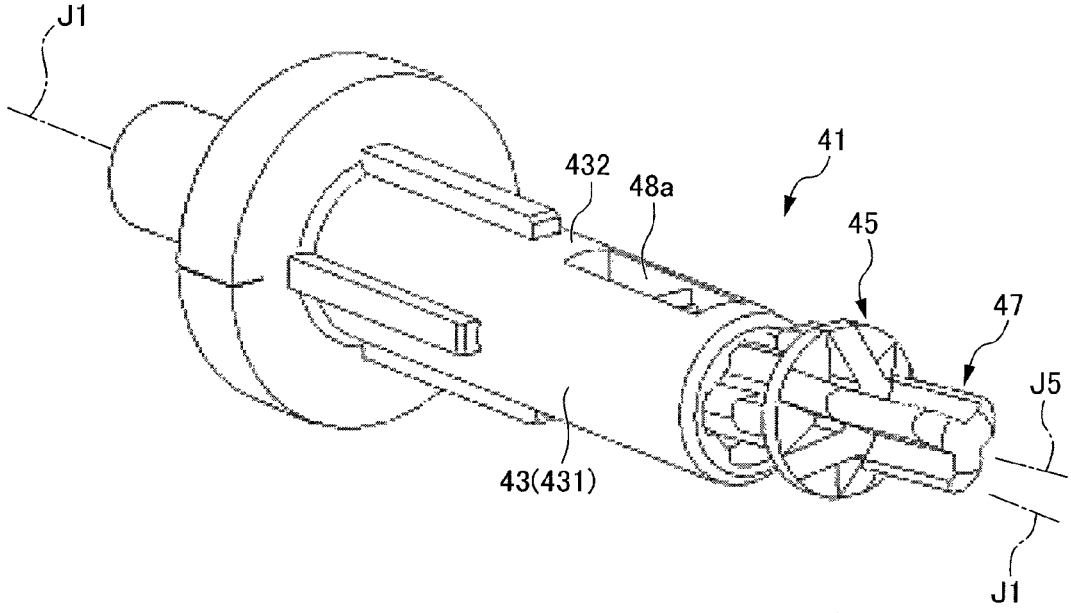
FIG. 10B is a perspective view illustrating the first joint 41 in the configuration illustrated in FIG. 10A.
Figure 11A:
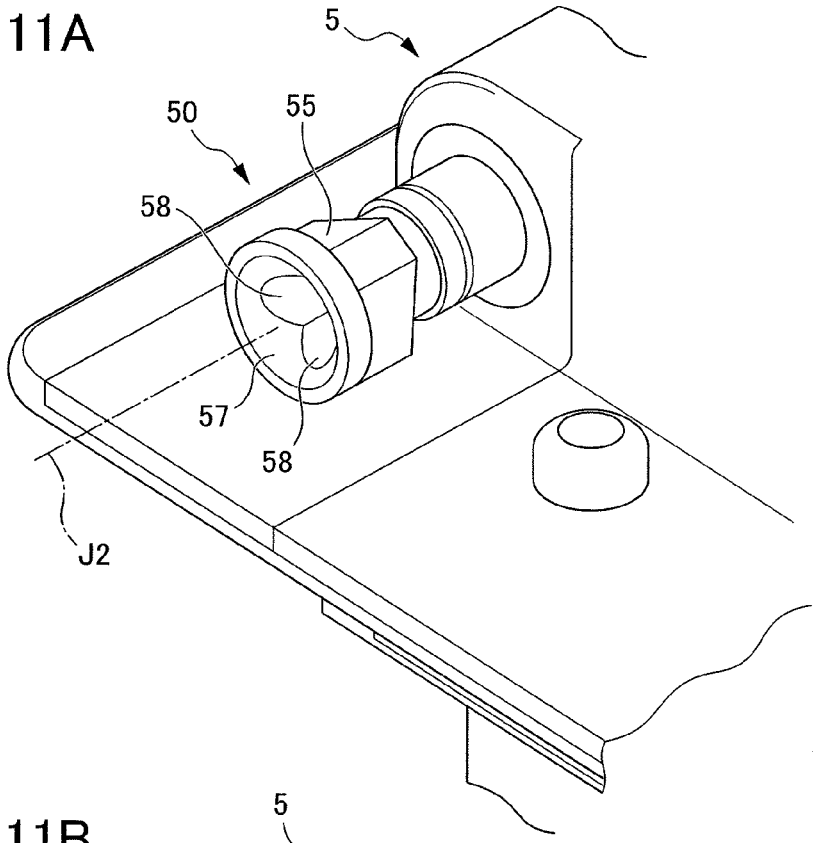
FIG. 11A is a perspective view illustrating the periphery of the second joint 50 in the toner storage container 5.
Figure 11B:
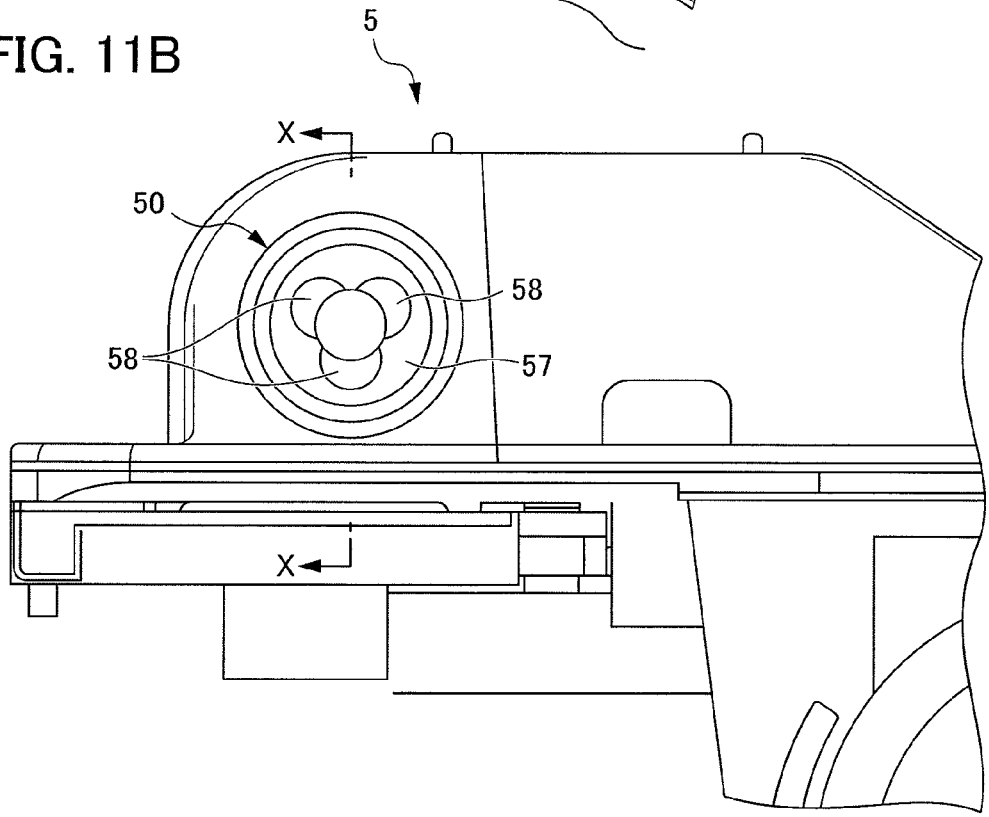
FIG. 11B is a rear view illustrating the periphery of the second joint 50 in the toner storage container 5.

Detailed description of the shaft connection mechanism 60 that is mainly configured from the first joint 41 and the second joint 50 will be given below. FIG. 8 is a perspective view illustrating a first engagement member 45 of a first joint 41. FIG. 9A is a sectional view illustrating a section of the first joint 41 on a sectional surface including a first rotation axis J1. FIG. 9B is a perspective view illustrating the first joint 41. FIG. 10A is a sectional view illustrating a section of the first joint 41 on a sectional surface including the first rotation axis J1 when the first engagement member 45 is in an inclined configuration with respect to the first rotation axis J1. FIG. 10B is a perspective view illustrating the first joint 41 in the configuration illustrated in FIG. 10A. FIG. 11A is a perspective view illustrating the periphery of the second joint 50 in the toner storage container 5. FIG. 11B is a rear view illustrating the periphery of the second joint 50 in the toner storage container 5.

As illustrated in FIG. 6 to FIG. 10B, the first joint 41 includes a first main body 43 that is substantially incapable of rotation with reference to the first shaft, a first engagement member 45 that is biased from the first main body 43 along the first rotation axis J1 toward the second joint 50, and a coil spring 44 that acts as a biasing member to bias the first engagement member 45.

In the present disclosure, in addition to the configuration in which rotation is completely not possible, the term "substantially incapable of rotation" includes the configuration in which simultaneous rotation is functionally fixed to the greatest degree possible (incapable of rotation) although some rotation due to looseness, slip or the like may be produced.

The first main body 43 includes a cylindrical body 431 that is coaxial to the first rotation axis J1 of the first shaft. The first main body 43 includes an end opening portion 49 in a direction along the first rotation axis J1 and on an end portion near to the second joint 50, and includes a pair of external grooves 48*a*, 48*b* on an outer peripheral portion 432 of a cylindrical body 431. The external grooves 48*a*, 48*b* extend along the first rotation axis J1, and extend in a radial direction from the outer peripheral portion 432 along an internal space 433 of the cylindrical body 431. The pair of external grooves 48*a*, 48*b* is disposed at 180 degrees in a circumferential direction (on opposite sides in a circumferential direction (or radial direction)).

The number of external grooves is not limited to two as long as more than one is provided.

The first engagement member 45 (more particularly, the internal base portion 451 described below) is a bar-shaped member when viewed overall that is disposed to have a play (looseness) in the internal space 433 of the first main body 43. The first engagement member 45 extends and projects outwardly from the internal space 433 of the first main body 43 through the end opening portion 49 to the outer portion of the first main body 43. The first engagement member 45 includes an internal base portion 451, a pair of base projections 46*a*, 46*b* and an engagement distal end portion 47.

The internal base portion 451 is disposed in the internal space 433 of the cylindrical body 431.

The pair of base projections 46*a*, 46*b* is provided to correspond to the pair of external grooves 48*a*, 48*b* and is disposed to have a play (looseness) in the respective external grooves 48*a*, 48*b*. The pair of base projections 46*a*, 46*b* regulate the rotation of the internal base portion 451 with respect to the first main body 43 by respective disposition in the external grooves 48*a*, 48*b*. The base projections 46*a*, 46*b* extend in a bar configuration respectively from an outer surface of the internal base portion 451 outwardly in a radial direction.

The coil spring 44 is disposed to freely expand along the first rotation axis J1 in the internal space 433 of the first main body 43. The coil spring 44 is disposed in a compressed configuration between the bottom portion 434 of the internal space 433 and the end portion 452 of the internal base portion 451 of the first engagement portion 45 (that is to say, in a configuration in which a return force is produced). Consequently, the first engagement member 45 is biased by the return force of the coil spring 44 in an outward direction (in a direction towards the second joint 50) along the first rotation axis J1. As long as biasing of the first engagement member 45 is enabled, the biasing member is not limited to a coil spring 44, and may be a structural member such as another resilient member such as a plate spring, a pressing mechanism or the like.

As illustrated in FIG. 7 to FIG. 10B, the engagement distal end portion 47 is connected with the internal base portion 451, and is disposed near to the engaging recessed portion 57 (described in detail below) of the second joint 50 on an outer portion of the cylindrical body 431. The engagement distal end portion 47 is shaped to project in three radial directions from the radial center. Three blade portions 471, 471, 471 projecting in a radial direction are disposed to subtend a central angle of 120 degrees in the same peripheral direction.

As illustrated in FIG. 8 to FIG. 10B, the base projections 46*a*, 46*b* include a step portion 46*c*, 46*d*. The step portions 46*c*, 46*d* are formed at a position in a direction (near the second joint 50) in which the first engagement member 45 is biased of the respective base projections 46*a*, 46*b*. Corners of the step portions 46*c*, 46*d* are formed smoothly by rounding processing. The step portions 46*c*, 46*d* abut with the respective end portions 48*c*, 48*d* of the external grooves 48*a*, 48*b* on the side on which the first engagement member 45 projects. In this manner, the first engagement member 45 is fixed in a configuration along the first rotation axis J1 of the first joint 41. That is to say, the step portions 46*c*, 46*d* operate to ensure fixing of the first joint 41 by the base projections 46*a*, 46*b*.

The internal base portion 451 is inserted to have a play (looseness) in the internal space 433 of the first main body 43, and the base projections 46*a*, 46*b* are disposed to have a play (looseness) in the respective external grooves 48*a*, 48*b*. In this manner, the first engagement member 45 is configured to rock only in a predetermined direction relative to the first main body 43 or the first rotation axis J1 (refer to FIG. 10A, FIG. 10B and FIG. 13C).

As illustrated in FIG. 6 to FIG. 11B, the second joint 50 includes a second main body 55 and the engaging recessed portion 57. The second main body 55 is disposed to be substantially incapable of rotation relative to the second shaft. The engaging recessed portion 57 is provided on the second main body 55, and is a recessed portion that opens towards the first joint 41 along the second rotation axis J2. The engaging recessed portion 57 enables accommodation of the first engagement member 45 of the first joint 41 and engages with the accommodated first engagement member 45 in a configuration that is substantially incapable of rotation. The engaging recessed portion 57 and the first engagement member 45 can be engaged in a configuration that includes a play (looseness).

The engaging recessed portion 57 has a shape that corresponds with the engagement distal end portion 47 (that has a shape that projects from the center in a radial direction in three radial directions). More specifically, the engaging recessed portion 57 includes three engaging grooves 58, 58, 58 extending in three radial directions from the radial center corresponding to the three blade portions 471, 471, 471. The three engaging grooves 58, 58, 58 extend along the second rotation axis J2 and are disposed to subtend a central angle of 120 degrees in the same peripheral direction.

The engaging groove 58 can engage with the blade portion 471 of the engagement distal end portion 47 of the first joint 41 and can be engaged in a configuration that includes a play (looseness). The three blade portions 471, 471, 471 and the three engaging grooves 58, 58, 58 are respectively engaged to thereby enable engagement of the first joint 41 and the second joint 50.

The number of blade portions 471 and engaging grooves 58 is not limited to three, and when dispersal of the load produced by the engagement force is considered, two to four components is suitable. The configuration of the engagement between the first joint 41 and the second joint 50 is not limited to an engagement between the blade portion 471 and the engaging groove 58.

As illustrated in FIG. 13, in a toner supply apparatus 30 according to the present embodiment, when the first engagement member 45 is accommodated in the engaging recessed portion 57 and the first rotation axis J1 is not aligned with the second rotation axis J2, the first engagement member 45 inclines relative to the first rotation axis J1 and can engage with the engaging recessed portion 57 in that configuration. That configuration will be described in detail below.

Figure 12A:
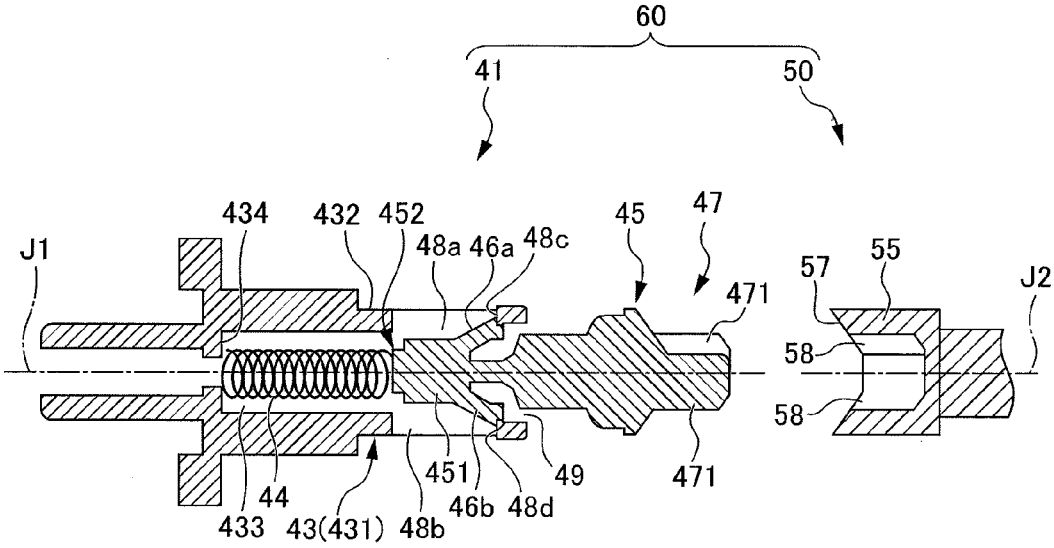
FIG. 12A is a sectional view of a configuration in which the first joint 41 is not connected to the second joint 50 and the first rotation axis J1 is aligned with a second rotation axis J2.
Figure 12B:
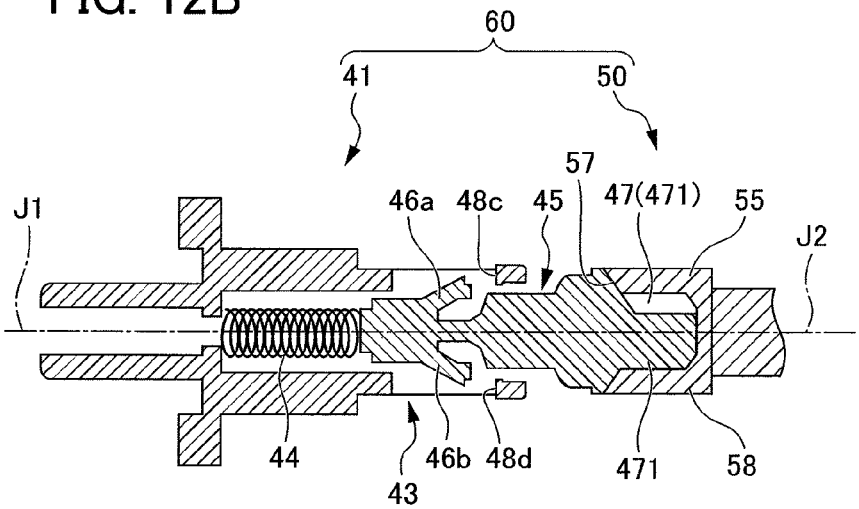
FIG. 12B is a sectional view of a configuration in which the first joint 41 is connected to the second joint 50 and the first rotation axis J1 is aligned with a second rotation axis J2.

Next, the operation of engaging the first joint 41 of the development device 4 and the second joint 50 of the toner storage container 5 to thereby connect the development device 4 and the toner storage container 5 will be described. FIG. 12A is a sectional view of a configuration in which the first joint 41 is not connected to the second joint 50 and the first rotation axis J1 is aligned with a second rotation axis J2. FIG. 12B is a sectional view of a configuration in which the first joint 41 is connected to the second joint 50 and the first rotation axis J1 is aligned with a second rotation axis J2.

Figure 13A:
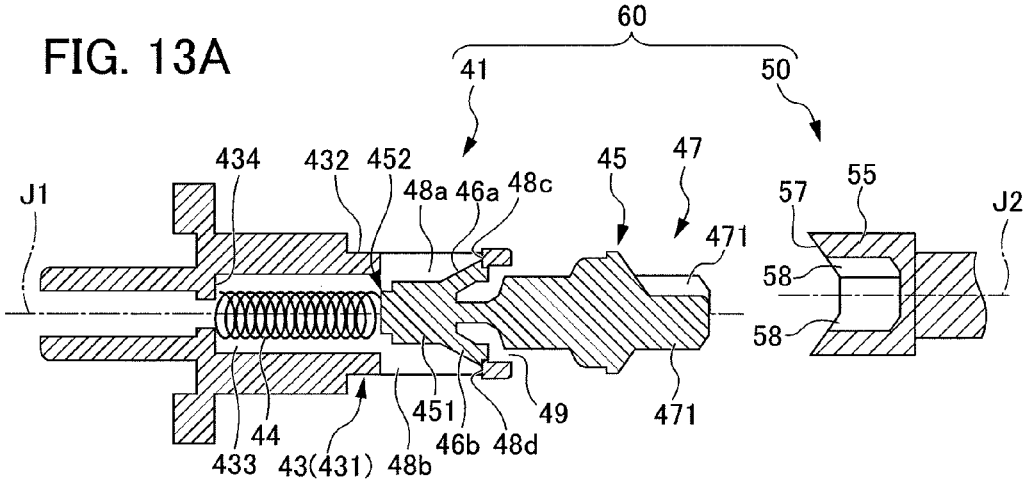
FIG. 13A is a sectional view of a configuration in which the first joint 41 is not connected to the second joint 50 and there is a deviation in the parallel orientation of the first rotation axis J1 and the second rotation axis J2.
Figure 13B:
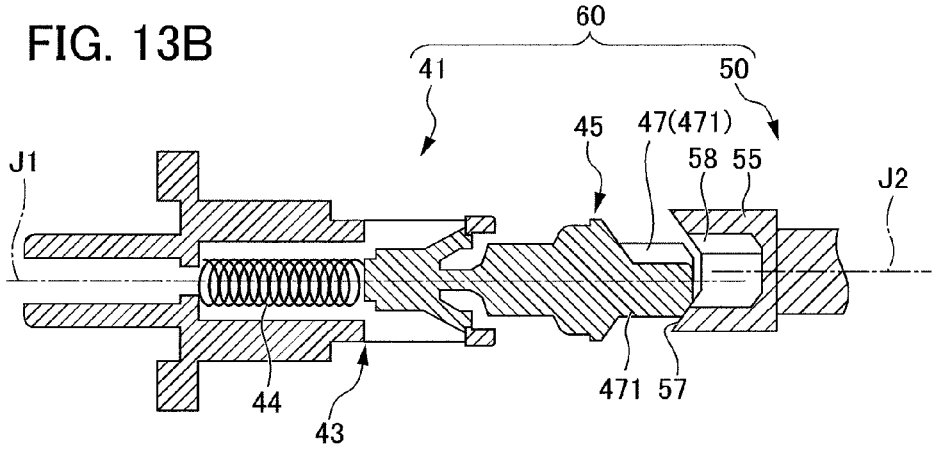
FIG. 13B is a sectional view illustrating a configuration in which the first joint 41 starts to be accommodated in the second joint 50 and there is a deviation in the parallel orientation of the first rotation axis J1 and the second rotation axis J2.
Figure 13C:
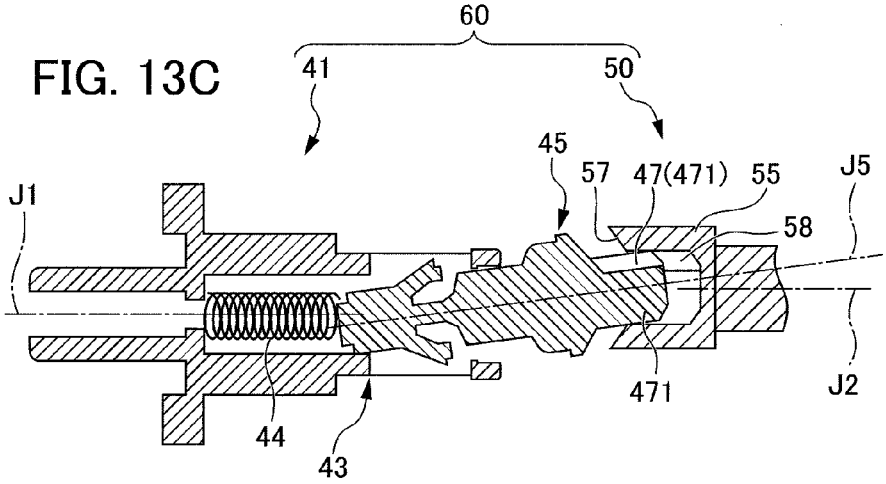
FIG. 13C is a sectional view of the connected configuration of the first joint 41 and the second joint 50 in a configuration in which the first rotation axis J1 is not aligned with the second rotation axis J2.

FIG. 13A is a sectional view of a configuration in which the first joint 41 is not connected to the second joint 50 and there is a deviation in the parallel orientation of the first rotation axis J1 and the second rotation axis J2. FIG. 13B is a sectional view illustrating a configuration in which the first joint 41 starts to be accommodated in the second joint 50 and there is a deviation in the parallel orientation of the first rotation axis J1 and the second rotation axis J2. FIG. 13C is a sectional view of the connected configuration of the first joint 41 and the second joint 50 in a configuration in which the first rotation axis J1 is not aligned with the second rotation axis J2. In the FIG. 12A to FIG. 13B, a sectional view of the first joint 41 is a sectional view corresponded to FIG. 9A and FIG. 10A. A sectional view of the second joint 50 is a sectional view taken along a line X-X in FIG. 11B.

As illustrated in FIG. 12A, when the first joint 41 of the development device 4 and the second joint 50 of the toner storage container 5 are not engaged, the base projection 46*a*, 46*b* of the first engagement member 45 abuts with the end portion 48*c*, 48*d* of the external grooves 48*a*, 48*b* of the first main body 43 as a result of the operation of the coil spring 44 on the first joint 41. In this configuration, the first engagement member 45 is fixed in a configuration along the first rotation axis J1 of the first joint 41 without being depressed by the action of gravity. The action of the step portions 46*c*, 46*c* ensures fixation of the first engagement member 45 to thereby correct shaking from the central axis.

When the first rotation axis J1 of the first joint 41 and the second rotation axis J2 of the second joint 50 are aligned, as illustrated in FIG. 12A and FIG. 12B, the first joint 41 of the development device 4 and the second joint of the toner storage container 5 are disposed in close proximity to thereby enable smooth engagement of the first joint 41 and the second joint 50. In this configuration, the first engagement member 45 is pressed by the engaging recessed portion 57 (second main body 55), the coil spring 44 is compressed, and as a result, the base projections 46*a*, 46*b* of the first engagement member 45 separate from the end portions 48*c*, 48*d* of the external grooves 48*a*, 48*b* of the first main body 43.

The peripheral position of the three blade portions 471, 471, 471 is not aligned with that of the three engaging grooves 58, 58, 58, and for that reason, engagement of the first joint 41 may not be possible with the second joint 50. In this case, the first shaft is driven and rotates, and the first joint 41 rotates outwardly. When the peripheral position of the three blade portions 471, 471, 471 becomes aligned with that of the three engaging grooves 58, 58, 58, the first joint 41 is displaced towards the second joint 50 by the action of the coil spring 44 and the first joint 41 becomes engaged with the second joint 50.

However, in the present embodiment, the position of the photosensitive drum 40*a* is fixed and determined by mounting on the housing of the copying machine 1. The development device 4 is detachably disposed on the housing of the copying machine 1 with respect to the position of the photosensitive drum 40*a* (the position of the development device 4 on the housing is not determined). On the other hand, the toner storage container 5 is detachably fixed to the attachment portion (not shown) that determines the position of the housing of the copying machine 1 in the same manner as the photosensitive drum 40*a*.

As a result, a deviation may result in the positional relationship of the development device 4 and the toner storage container 5. This deviation often causes a lack of alignment (in particular a parallel deviation) between the first rotation axis J1 of the first joint 41 of the development device 4 and the second rotation axis J2 of the second joint 50 of the toner storage container 5. Next, the engagement operation of the first joint 41 of the development device 4 and the second joint 50 of the toner storage container 5 when the first rotation axis J1 and the second rotation axis J2 deviate in parallel will be described.

As illustrated in FIG. 13A, when the first joint 41 of the development device 4 and the second joint 50 of the toner storage container 5 are not engaged, the first engagement member 45 on the first joint 41 is fixed in a configuration along the first rotation axis J1 of the first joint 41 without being depressed by the action of gravity. However, the first rotation axis J1 and the second rotation axis J2 deviate in parallel.

As illustrated in FIG. 13A and FIG. 13B, when the first joint 41 of the development device 4 and the second joint 50 of the toner storage container 5 are displaced into proximity for engagement, and the first rotation axis J1 and the second rotation axis J2 are in a configuration of deviating in parallel, the engagement distal end portion 47 of the first engagement member 45 of the first joint 41 catches on the engaging recessed portion 57 of the second joint 50. Herein, the first rotation axis J1 and the second rotation axis J2 are taken to not deviate to the extent that the engagement distal end portion 47 of the first engagement member 45 of the first joint 41 cannot catch on the engaging recessed portion 57 of the second joint 50.

In this configuration, when the first joint 41 and the second joint 50 further displace into proximity, the engagement distal end portion 47 of the first engagement member 45 is pressed towards the coil spring 44 by the engaging recessed portion 57 of the second joint 50. In this manner, the coil spring 44 is compressed, and a biasing force towards the engaging recessed portion 57 of the second joint 50 is produced in the first engagement member 45. At the same time, the engagement distal end portion 47 of the first engagement member 45 varies the inclination (rocks) towards the second rotation axis J2, and the axial direction J5 of the first engagement member 45 inclines towards either the first rotation axis J1 or the second rotation axis J2.

In the present embodiment, the internal base portion 451 is inserted with a play (looseness) in the internal space 433 of the first main body 43. The base projections 46*a*, 46*b* are disposed with a play (looseness) in the respective external grooves 48*a*, 48*b*, and furthermore, the blade portion 471 of the engagement distal end portion 47 of the first engagement member 45 can be engaged to have a play (looseness) in the engaging groove 58 of the engaging recessed portion 57.

As a result, as illustrated in FIG. 13C, even when the axial direction J5 of the first engagement member 45 inclines towards either the first rotation axis J1 or the second rotation axis J2, the first joint 41 and the second joint 50 are engaged, and transmission of rotation between the first joint 41 and the second joint 50 is possible. That is to say, according to the present embodiment, even when the first rotation axis J1 of the first joint 41 and the second rotation axis J2 of the second joint 50 are not in alignment and are deviate, transmission of rotation between the first joint 41 of the development device 4 and the second joint 50 of the toner storage container 5 is possible.

The following effects for example are enabled according to the toner supply apparatus 30 of the present embodiment. In, the toner supply apparatus 30 according to the present embodiment, the first joint 41 includes a first main body 43 that is substantially incapable of rotation relative to the first shaft of the development device 4, a first engagement member 45 that is biased from the first main body 43 towards the second joint 50 and a coil spring 44 that acts as a biasing member to bias the first engagement member 45. The second joint 50 includes a second main body 55 that is substantially incapable of rotation relative to the second shaft of the toner storage container 5, and an engaging recessed portion 57 that is disposed on the second main body 55, that opens towards the first joint 41 to thereby enable accommodation of the first engagement member 45 of the first joint 41 and engages with the accommodated first engagement member 45 in a configuration that is substantially incapable of rotation. In a configuration in which the first rotation axis J1 and the second rotation axis J2 are not aligned, and the first engagement member 45 is accommodated in the engaging recessed portion 57, the first engagement member 45 inclines towards the first rotation axis J1 and the second rotation axis J2 and, in that configuration, can engage with the engaging recessed portion 57.

As a result, according to the toner supply apparatus 30 of the present embodiment, since the first engagement member 45 is biased by the coil spring 44 from the first main body 43 towards the second joint 50, the direction of extension of the first engagement member 45 tends to be oriented in a direction along the first rotation axis J1. Therefore, as illustrated in FIG. 12A and FIG. 12B, when the first rotation axis J1 of the first joint 41 and the second rotation axis J2 of the second joint 50 are in alignment, the first joint 41 of the development device 4 and the second joint 50 of the toner storage container 5 can engage smoothly. Furthermore, a configuration of engagement between the first engagement member 45 of the first joint 41 and the engaging recessed portion 57 of the second joint 50 can be easily maintained. As a result, since the first shaft of the development device 4 can be easily connected with the second shaft of the toner storage container 5, and the connected configuration can be easily maintained, transmission of rotation between the first shaft and the second shaft can be more accurately ensured.

Furthermore, as illustrated in FIG. 13C, according to the toner supply apparatus 30 of the present embodiment, when the first rotation axis J1 and the second rotation axis J2 are not in alignment, and the first engagement member 45 is accommodated in the engaging recessed portion 57, the first engagement member 45 inclines toward the first rotation axis J1 and the second rotation axis J2 and can engage in that configuration with the engaging recessed portion 57. Therefore, even when a deviation occurs in the positional relationship of the development device 4 and the toner storage container 5, suitable connection between the first shaft of the development device 4 and the second shaft of the toner storage container 5 is facilitated. As a result, transmission of rotation between the first shaft and the second shaft can be more accurately ensured.

Furthermore, in the toner supply apparatus 30 according to the present embodiment, the first main body 43 includes the cylindrical body 431 that is coaxial to the first rotation axis J1, and is provided with external grooves 48*a*, 48*b* that extend along the first rotation axis J1 on the outer peripheral portion 432 of the cylindrical body 431 and that extend radially along the internal space 433 of the cylindrical body 431 from the outer peripheral portion 432. The first engagement member 45 includes the internal base portion 451 disposed in the internal space 433 of the cylindrical body 431, base projections 46*a*, 46*b* that can be disposed in the external grooves 48*a*, 48*b* to limit the rotation of the internal base portion 451 with respect to the first main body 43 when disposed in the external grooves 48*a*, 48*b*, and the engagement distal end portion 47 connected to the internal base portion 451 and disposed near to the engaging recessed portion 57 on an outer portion of the cylindrical body 431. The engaging recessed portion 57 includes the engaging groove 58 that can engage with the engagement distal end portion 47.

Consequently, when the toner supply apparatus 30 according to the present embodiment has a configuration in which the base projections 46*a*, 46*b* are disposed in the external grooves 48*a*, 48*b*, rotation of the internal base portion 451 with respect to the first main body 43 is limited. In this manner, the first engagement member 45 does not rotate with respect to the first main body 43, and the rocking direction is limited. Consequently, the shaft connection mechanism 60 formed from the first joint 41 and the second joint 50 functions as an improved universal joint (universal coupling).

Although the preferred embodiments of the present disclosure have been described above, the present disclosure is not limited to those embodiments, and the disclosure may be worked in various aspects.

For example, in the above embodiments, although the first joint 41 is provided on the first shaft of the development device 4, and the second joint 50 is provided on the second shaft of the toner storage container 5, the disclosure is not limited in that regard. By use of an opposite configuration to the above, the first joint 41 can be provided on the second shaft of the toner storage container 5 and the second joint 50 may be provided on the first shaft of the development device 4.

There is no particular limitation on the type of image forming apparatus, and the device may include a copying machine, a printer, a facsimile, or a multifunction peripheral being a combination of those devices.

In the above embodiments, although the toner image formed on the photosensitive drum 40*a* is directly transferred onto the sheet (direct transfer method), there is no particular limitation in this regard. The image forming apparatus according to the present disclosure may transfer the toner image formed on the photosensitive drum 40*a* indirectly to a sheet via an intermediate transfer belt (indirect transfer method).

What is claimed is:

1. A toner supply apparatus comprising a development device having a first shaft that rotates about a first rotation axis;

a toner storage container for supplying toner to the development device and having a second shaft that rotates about a second rotation axis extending along the first rotation axis; and a shaft connection mechanism having a first joint and a second joint, and the first joint and the second joint engaging to enable connection of the first shaft and the second shaft in a direction along the first rotation axis and the second rotation axis, and enabling transmission of rotation between the first shaft and the second shaft; wherein the first joint having a first main body being substantially incapable of rotation with respect to either one of the first shaft or the second shaft, a first engagement member biased from the first main body towards the second joint, and a biasing member for biasing the first engagement member;

the second joint having a second main body being substantially incapable of rotation with respect to the other of the first shaft or the second shaft, and an engaging recessed portion being provided on the second main body, opening towards the first joint, enabling accommodation of the first engagement member of the first joint and engaging with the accommodated first engagement member in a configuration that is substantially incapable of rotation; and when the first engagement member is accommodated in the engaging recessed portion and the first rotation axis is not aligned with the second rotation axis, the first engagement member inclines relative to the first rotation axis or the second rotation axis and can engage with the engaging recessed portion in that configuration.

2. The toner supply apparatus according to claim 1, wherein the first main body is formed from a cylindrical body that is coaxial to the first rotation axis or the second rotation shaft, and has an external groove extending along the first rotation axis or the second rotation axis on an outer peripheral portion of a cylindrical body, and extending in a radial direction from the outer peripheral portion along an internal space of the cylindrical body;

the first engagement member having an internal base portion disposed in the internal space of the cylindrical body;

a base projection disposable in the external groove for limiting rotation of the internal base portion with respect to the first main body when disposed in the external groove;

an engagement distal end portion connected with the internal base portion, and disposed near to the engaging recessed portion on an outer portion of the cylindrical body; and the engaging recessed portion having an engaging groove that can engaged with the engagement distal end portion.

3. The toner supply apparatus according to claim 1, wherein the first shaft rotates in response to the rotation shaft of a development roller in the development device; and the second shaft is a rotation shaft of a carrying screw for discharging toner in the toner storage container.

4. The toner supply apparatus according to claim 2, wherein the first shaft rotates in response to the rotation shaft of a development roller in the development device; and the second shaft is a rotation shaft of a carrying screw for discharging toner in the toner storage container.

5. An image forming apparatus having an image carrier forming an electrostatic image on a surface, the toner supply apparatus according to claim 1, and a fixing unit, wherein the development device forms a toner image on the image carrier by transfer of toner onto the electrostatic image formed on the image carrier;

the toner image formed on the image carrier is transferred to a sheet; and the fixing unit heats the sheet having the transferred toner image and fixes the toner image to the sheet.

6. A toner storage container for supplying toner to a development device that has a first shaft that rotates about a first rotation axis, the toner storage container comprising a second shaft that rotates about a second rotation axis extending along the first rotation axis; and one of a first joint or a second joint of a shaft connection mechanism including a first joint and a second joint, the first joint and the second joint engaging to enable connection of the first shaft and the second shaft in a direction along the first rotation axis and the second rotation axis, and enabling transmission of rotation between the first shaft and the second shaft; wherein the first joint having a first main body being substantially incapable of rotation with respect to either one of the first shaft or the second shaft, a first engagement member biased from the first main body towards the second joint, and a biasing member for biasing the first engagement member;

the second joint having a second main body being substantially incapable of rotation with respect to the other of the first shaft or the second shaft; and an engaging recessed portion being provided on the second main body, opening towards the first joint, enabling accommodation of the first engagement member of the first joint and engaging with the accommodated first engagement member in a configuration that is substantially incapable of rotation; and when the first engagement member is accommodated in the engaging recessed portion and the first rotation axis is not aligned with the second rotation axis, the first engagement member inclines relative to the first rotation axis or the second rotation axis and can engage with the engaging recessed portion in that configuration.

7. The toner storage container according to claim 6, wherein the first main body is formed from a cylindrical body that is coaxial to the first rotation axis or the second rotation shaft, and has an external groove extending along the first rotation axis or the second rotation axis on an outer peripheral portion of a cylindrical body, and extending in a radial direction from the outer peripheral portion along an internal space of the cylindrical body;

the first engagement member having an internal base portion disposed in the internal space of the cylindrical body;

a base projection disposable in the external groove for limiting rotation of the internal base portion with respect to the first main body when disposed in the external groove;

an engagement distal end portion connected with the internal base portion, and disposed near to the engaging recessed portion on an outer portion of the cylindrical body; and the engaging recessed portion having an engaging groove that can engaged with the engagement distal end portion.

8. The toner storage container according to claim 6, wherein the first shaft rotates in response to the rotation shaft of a development roller in the development device; and the second shaft is a rotation shaft of a carrying screw for discharging toner in the toner storage container.

9. The toner storage container according to claim 7, wherein the first shaft rotates in response to the rotation shaft of a development roller in the development device; and the second shaft is a rotation shaft of a carrying screw for discharging toner in the toner storage container.

* * * * *